US008033155B2

(12) United States Patent
Sasaki et al.

(10) Patent No.: US 8,033,155 B2
(45) Date of Patent: Oct. 11, 2011

(54) PRESS DIE SET FOR FORMING FLANGE AND FLANGE FORMING METHOD

(75) Inventors: Koichi Sasaki, Hiroshima-ken (JP); Nobuyuki Shiozaki, Hiroshima-ken (JP)

(73) Assignee: Hirotec Corporation, Hiroshima-Ken (JP)

( * ) Notice: Subject to any disclaimer, the term of this patent is extended or adjusted under 35 U.S.C. 154(b) by 479 days.

(21) Appl. No.: 12/182,292

(22) Filed: Jul. 30, 2008

(65) Prior Publication Data

US 2010/0024510 A1 Feb. 4, 2010

(51) Int. Cl.
*B21D 11/20* (2006.01)
*B21D 11/00* (2006.01)

(52) U.S. Cl. ..... 72/452.9; 72/312; 72/315

(58) Field of Classification Search ..... 72/312, 72/313, 315, 320, 322, 323, 381, 384, 386, 72/403, 452.1, 452.8, 452.9, 347, 348
See application file for complete search history.

(56) References Cited

U.S. PATENT DOCUMENTS 6,539,766 B2 * 4/2003 Matsuoka ..... 72/313

FOREIGN PATENT DOCUMENTS

| | | | |
|---|---|---|---|
| JP | 63212016 A | * | 9/1988 |
| JP | 6-49375 | | 12/1994 |
| JP | 7-204751 | | 8/1995 |
| JP | 3013684 | | 12/1999 |

OTHER PUBLICATIONS

English language Abstract of JP 7-204751, Aug. 8, 1995.

* cited by examiner

*Primary Examiner* — Debra Sullivan
(74) *Attorney, Agent, or Firm* — Greenblum & Bernstein P.L.C.

(57) ABSTRACT

The present invention relates to a press die set for forming a flange that bends an edge of a part, such as a door panel and a hood panel, at a right angle in a press-forming direction and bends an edge adjacent to the edge at a negative angle, and a flange forming method. The press die set for forming a flange according to the present invention can accomplish the flange formation described above in one step, has a simple structure, and is easy to maintain.

4 Claims, 8 Drawing Sheets

(A)

(B)

(A)

(B)

PRESS DIE SET FOR FORMING FLANGE AND FLANGE FORMING METHOD

BACKGROUND OF THE INVENTION

1. Field of the Invention

The present invention relates to a press die set for forming a flange that bends an edge of a panel at a right angle in a press-forming direction and an edge adjacent to the edge at a negative angle and a flange forming method.

2. Description of the Related Art

Many automobile parts are formed by press working. Such parts include door parts that have a flange formed along the edge thereof. In many cases, the flange of the door part or the like is formed by right-angle bending, which is a technique of bending an edge of a panel at approximately a right angle in the press-forming direction. However, negative-angle bending is sometimes used, which is a technique of bending a panel at an angle greater than a right angle to cover the expanded portion of the lower die. In general, the panel bent at a negative angle is difficult to eject from the die set. Thus, in flange formation involving the negative-angle bending, a rotary cam type press die set, a double cam type press die set or the like, from which the panel can be easily ejected, is often used for press working. However, for press working of door panels, hood panels or the like that have an edge bent at a right angle in the press-forming direction and an edge adjacent to the edge bent at a negative angle, there are proposed working apparatus or methods that do not use the rotary cam type press die set, the double cam type press die set or the like, which are complicated and expensive.

For example, in Japanese Utility Model Publication No. 6-49375, there is proposed a composite pressing apparatus that can perform right-angle bending and negative-angle bending of an automobile hood panel at the same time in one step and has a mechanism for ejecting the worked panel from the lower die. It is described that the part of the composite pressing apparatus that is responsible for flange formation is movable, so that the panel can be easily released. In order to appropriately bend the boundary part between the negative-angle part and the right-angle part, many composite pressing apparatus including the apparatus described above have a cam bending blade for negative-angle bending having a substantially L-shaped profile and is configured so that a part of the edge bent at a right angle by a press bending blade is bent at a right angle by the cam bending blade, and the operation of the press bending blade slightly lags behind the operation of the cam bending blade. The term "one step" indicates the operation of the upper die which lowers to the lower die and then rises to the original position.

However, such composite pressing apparatus have a problem that deformation, such as strain and fracture, due to the difference in timing between the operation of the press bending blade and the cam bending blade is likely to occur. Japanese Patent No. 3013684 proposes a composite pressing apparatus that solves the problem. More specifically, Japanese Patent No. 3013684 proposes a composite pressing apparatus comprising a press bending blade that bends one of two adjacent edges of a curved workpiece in the same direction as the direction of pressing of an upper die and a cam bending blade that bends the other of the adjacent two edges at a negative angle inwardly with respect to the pressing direction of the upper die, in which the press bending blade has a movable bending blade at a part that overlaps with the cam bending blade during press working, and the adjacent two edges are bent at the same time by avoiding interference between the cam bending blade and the press bending blade by retracting the movable bending blade when the cam bending blade moves downward.

SUMMARY OF THE INVENTION

However, the composite pressing apparatus proposed in Japanese Patent No. 3013684 has a problem that the apparatus requires a specially designed component, such as the movable bending blade, and therefore the structure of the die set is complicated, although the apparatus can advantageously perform negative-angle bending and right-angle bending at the same time in one step and prevent deformation, such as strain and fracture, of the transitional part between the negative-angle part and the right-angle part in press working of a part, such as a door panel and a hood panel.

The present invention has been devised in view of such problems with the related art, and an object of the present invention is to provide a press die set for forming a flange that bends an edge of a panel, such as a door panel and a hood panel, at a right angle in a press-forming direction, bends an edge adjacent to the edge at a negative angle, has a simple structure and can accomplish the bendings in one step, and a flange forming method.

A press die set for forming a flange according to an aspect of the present invention is a press die set for forming a flange that bends an edge of a panel at a right angle in a press-forming direction and an edge adjacent to the edge at a negative angle, comprising: an upper die having a fixed die used for right-angle bending and a slide cam that slides in a direction perpendicular to the press-forming direction to perform negative-angle bending; and a lower die having a fixed punch associated with the fixed die, a fixed punch associated with the slide cam and a driver cam for guiding the slide cam, in which a bending blade of the slide cam has a right-angle bending forming portion provided at the top thereof and a negative-angle bending forming portion immediately following the right-angle bending forming portion.

In the aspect of the present invention described above, the slide cam preferably has a resilient body that urges the slide cam into a rest position, and the driver cam is preferably provided so that the slide cam slides in the direction perpendicular to the press-forming direction to perform negative-angle bending after the fixed die and the slide cam perform right-angle bending of the respective edges of the panel. Furthermore, a parting line between the bending blade of the slide cam and a bending blade of the fixed die is preferably intrudes into the edge to be bent at a negative angle from the edge to be bent at a right angle.

Furthermore, the press die set for forming a flange according to the aspect of the present invention described above preferably further comprises a panel lifter that abuts against an end face of a negative-angle flange to release the panel from the lower die. Furthermore, the panel lifter can have a plurality of ejectors that abut against the end face of the negative-angle flange of the panel, a coupling board to which the ejectors are integrally attached, a plurality of pressing means that operate within a predetermined range in a releasing direction in which the negative-angle flange is released from the lower die and urge the coupling board in the releasing direction, and a cam follower that abuts against the slide cam to maintain the coupling board in a predetermined position when the negative-angle flange is being worked.

A flange forming method according to another aspect of the present invention is a flange forming method of bending an edge of a panel at a right angle in a press-forming direction and an edge adjacent to the edge at a negative angle, in which a part bent at a right angle and a part bent at a negative angle are adjacent to each other at a parting line.

In the flange forming method described above, the parting line is preferably intrudes into the edge bent at a negative angle from the edge bent at a right angle.

A press die set for forming a flange according to an aspect of the present invention has a simple structure, is easy to maintain, and can perform press working to form an edge of a part, such as a door panel and a hood panel, into a continuous flange including a portion bent at a negative angle in one step.

BRIEF DESCRIPTION OF THE DRAWINGS

FIG. 6 includes diagrams showing a panel yet to be worked (shown by the alternate long and short dash line) and a panel after right-angle bending and negative-angle bending (shown by the solid line), in which FIG. 6(A) is a plane view, and FIG. 6(B) is a cross-sectional view taken along the line pOq;

DETAILED DESCRIPTION OF THE PREFERRED EMBODIMENTS

Figure 1:
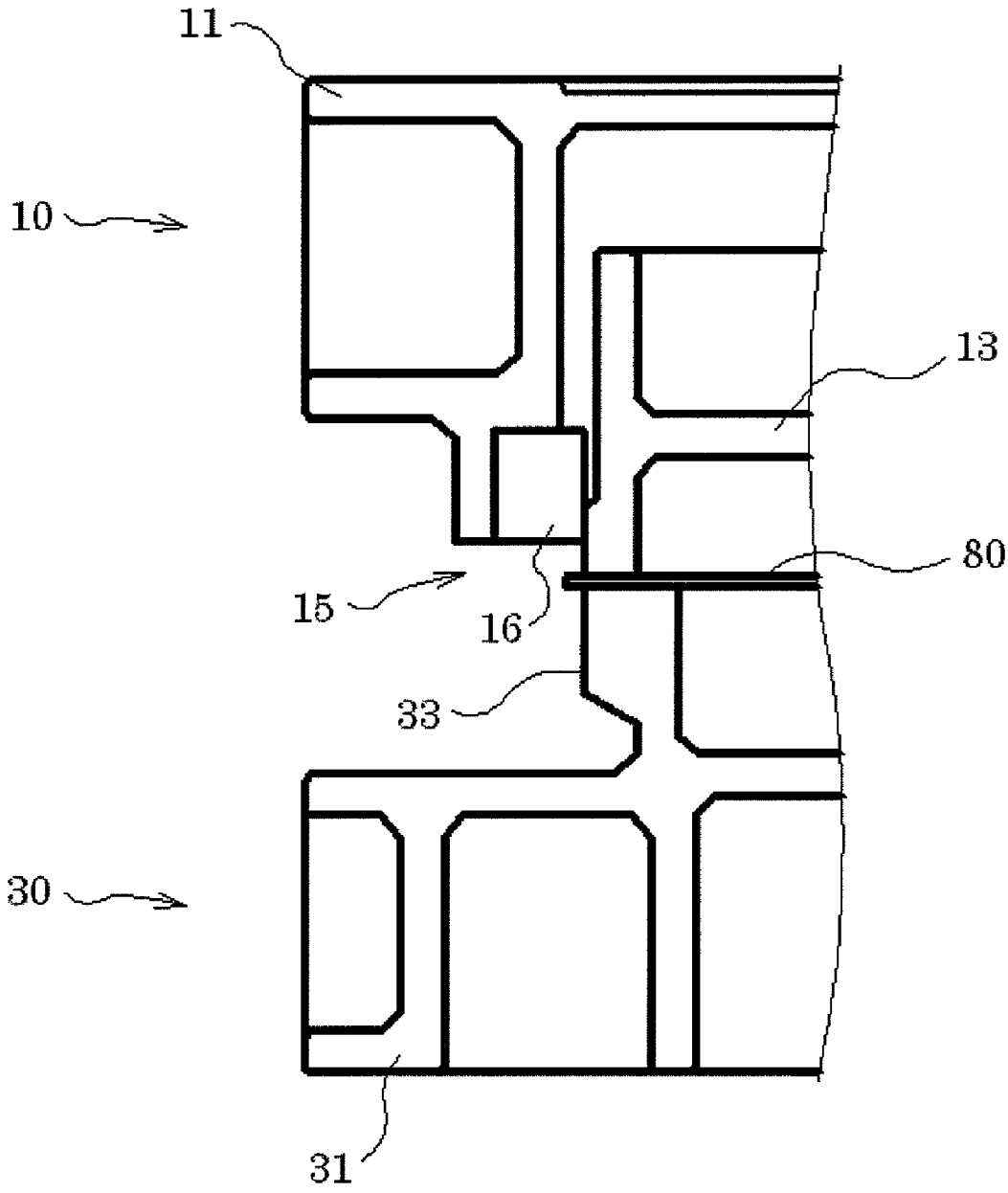
FIG. 1 is a partial cross-sectional view of a part of a press die set for forming a flange according to an embodiment of the present invention that is used for right-angle bending.
Figure 2:
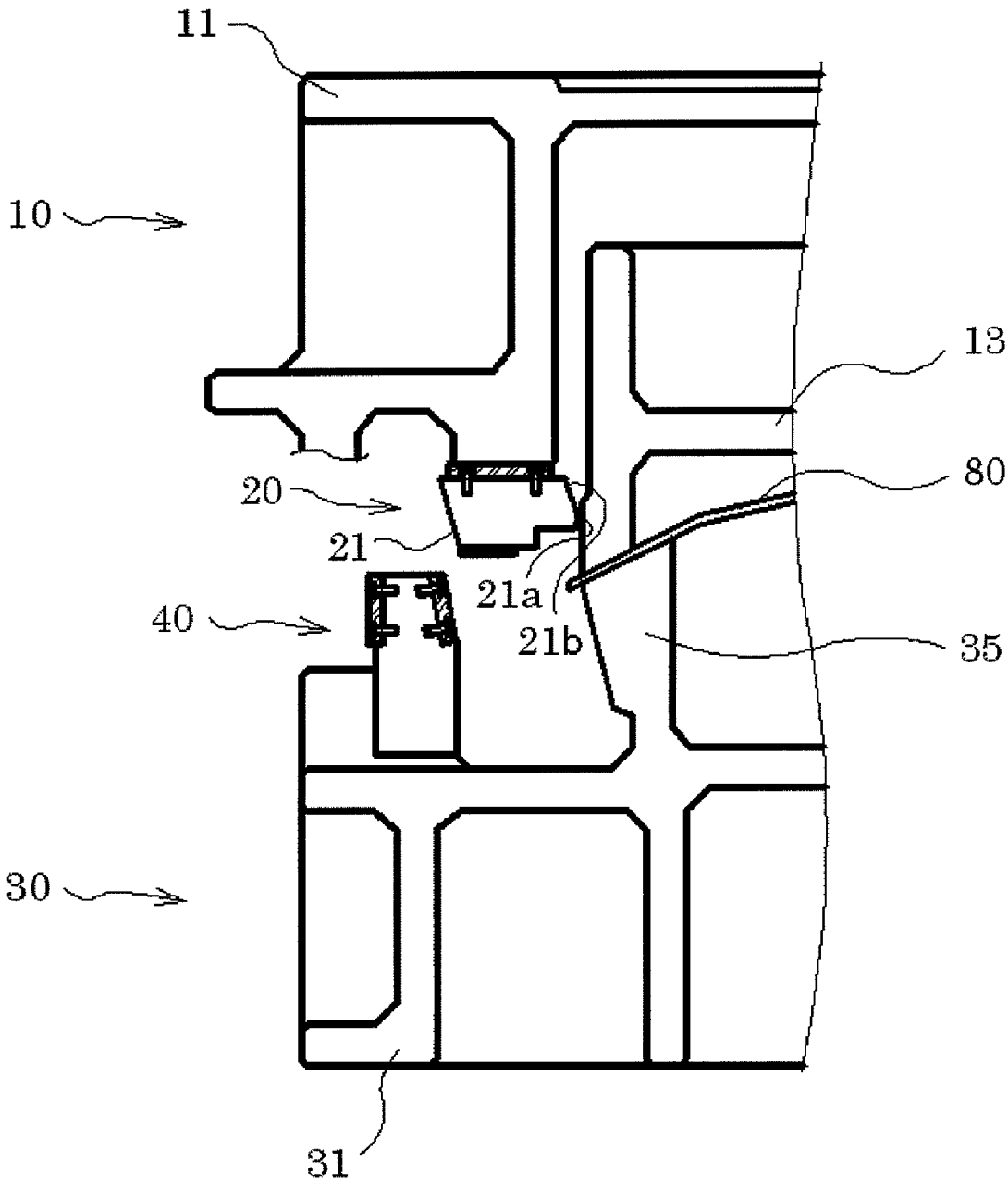
FIG. 2 is a partial cross-sectional view of a part of the press die set for forming a flange according to the embodiment of the present invention that is used for negative-angle bending.

In the following, a press die set for forming a flange according to an embodiment of the present invention will be described with reference to the drawings. FIGS. 1 and 2 are partial cross-sectional views showing a configuration of a press die set for forming a flange according to an embodiment of the present invention. FIG. 1 shows a portion of the press die set used for right-angle bending, and FIG. 2 shows a portion of the press die set used for negative-angle bending. As shown in FIGS. 1 and 2, an upper die 10 of the press die set for forming a flange has an upper die holder 11 and a pad 13, and a fixed die 15 and a slide cam 20 are attached to the upper die holder 11. The fixed die 15 has a bending blade 16, and the slide cam 20 has a bending blade 21. The bending blade 21 has a right-angle bending forming portion 21*a* at the top thereof and a negative-angle bending forming portion 21*b* immediately following the right-angle bending forming portion. The bending blade 21 enables easy negative-angle bending as described later. On the other hand, the lower die 30 of the press die set for forming a flange has a lower die holder 31 and fixed punches 33 and 35, and the lower die holder 31 has a driver cam 40.

In the press die set for forming a flange, the fixed die 15 is associated with the fixed punch 33 as shown in FIG. 1, and the slide cam 20 is associated with the fixed punch 35 as shown in FIG. 2. As described later, the driver cam 40 makes the slide cam 20 slide in a direction perpendicular to a press-forming direction (in the rightward direction in FIG. 2). Arranged in this way, the bending blade 16 of the fixed die 15 and the fixed punch 33 cooperate to bend a panel 80 at a right angle to form a flange, and the bending blade 21 of the slide cam 20 and the fixed punch 35 cooperate to bend the panel 80 at a negative angle to form a flange.

Figure 3:
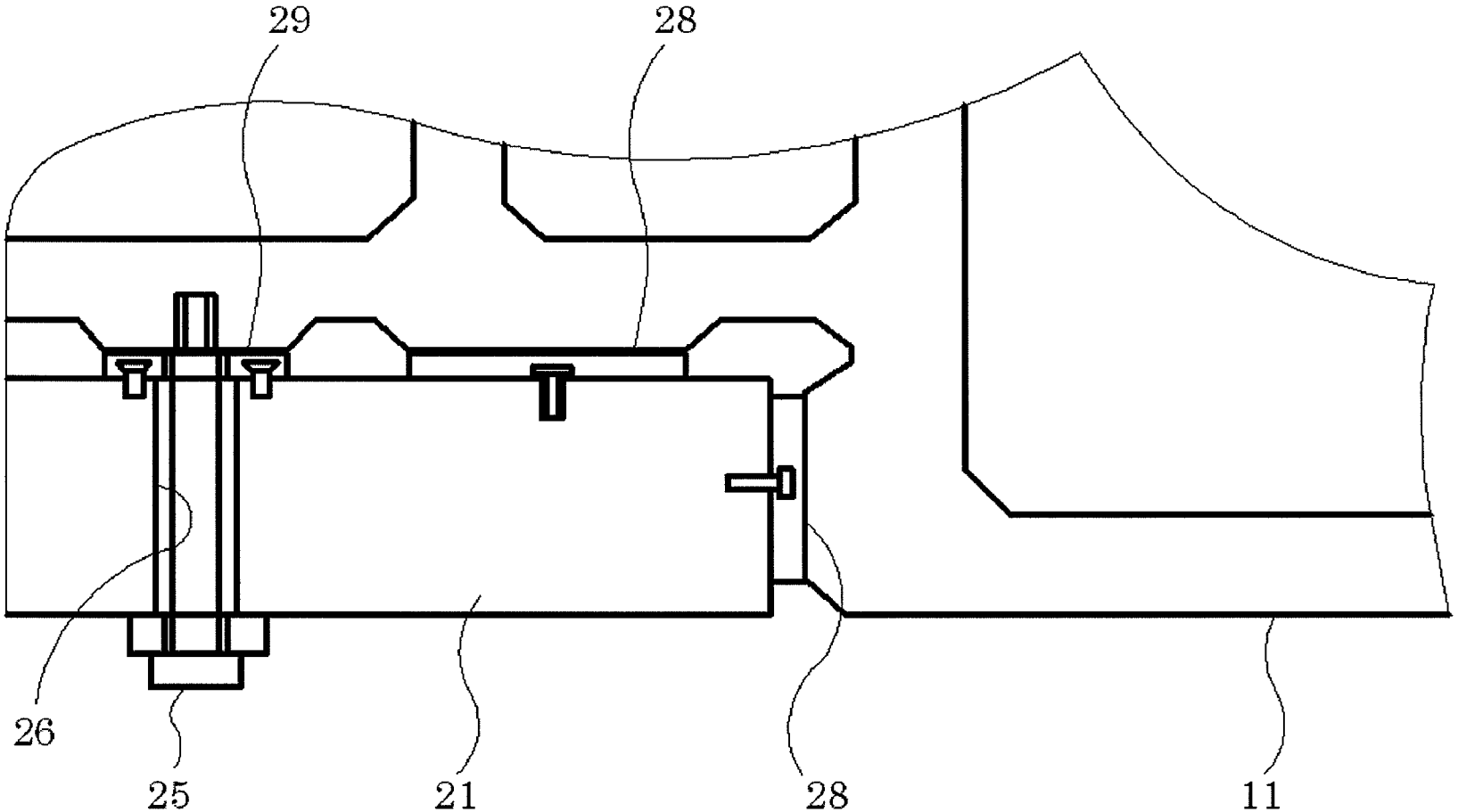
FIG. 3 is a partial cross-sectional view showing attachment of a slide cam shown in FIG. 2 to an upper die holder.

As shown in FIG. 3, the slide cam 20 is attached to the upper die holder 11 with an attachment bolt 25. A through-hole 26 for the attachment bolt 25 formed in the bending blade 21 of the slide cam 20 is an elongate hole or unloaded hole, so that the slide cam 20 is free to slide within a predetermined range. In addition, sliding members 28 and 29 are provided to allow the slide cam 20 to smoothly slide with respect to the upper die holder 11.

Figure 4:
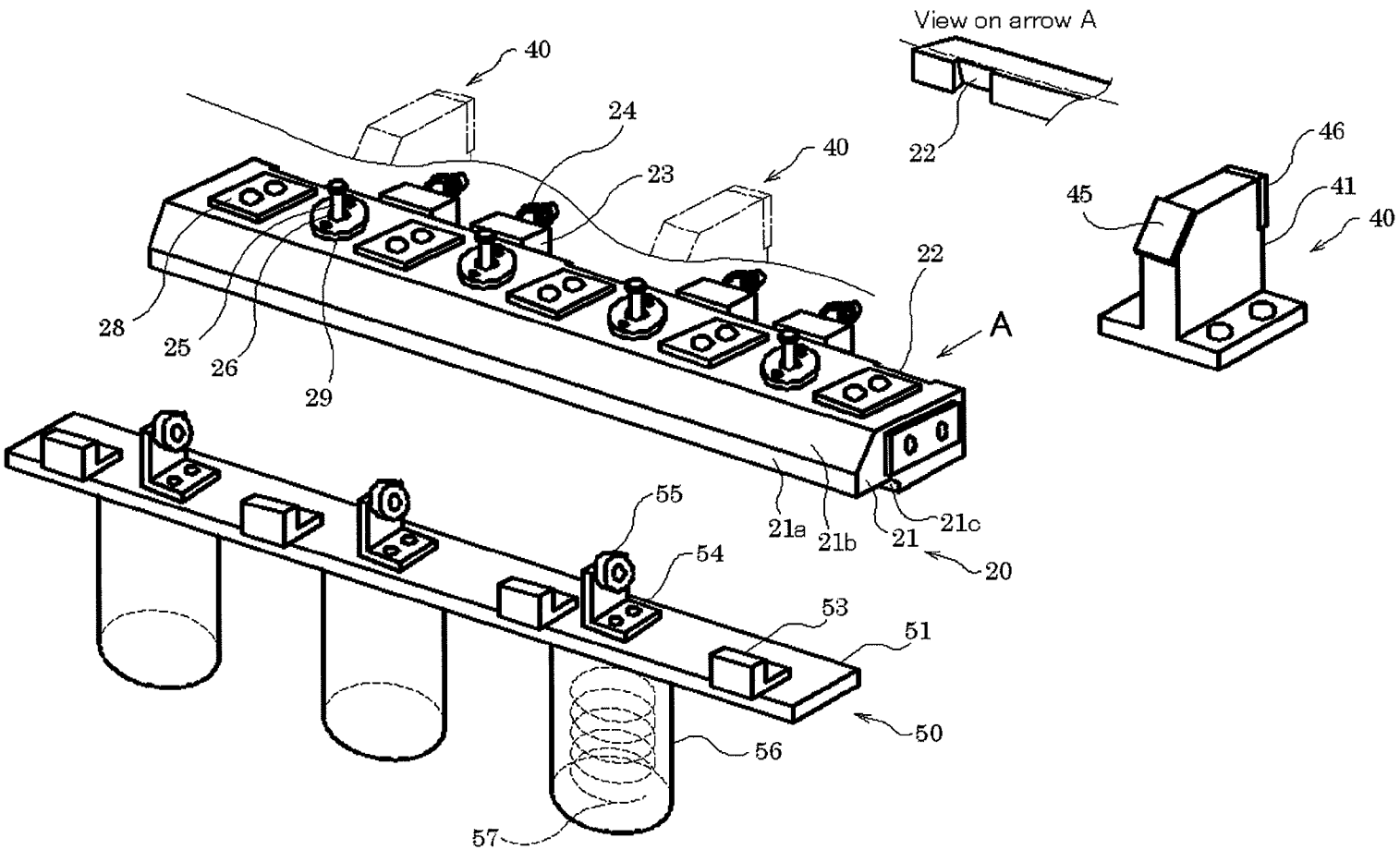
FIG. 4 is an enlarged perspective view showing the slide cam shown in FIG. 1 or 2, a driver cam associated with the slide cam, and a panel lifter.

As shown in FIG. 4, the bending blade 21 of the slide cam 20 has the shape of a rectangular column with one ridge trimmed off. The top flat portion thereof forms the right-angle bending forming portion 21*a*, and the inclined portion abutting on the right-angle bending forming portion 21*a* forms the negative-angle bending forming portion 21*b*. The inclination angle of the inclined portion depends on the angle of the negative-angle bending.

In addition, as shown in FIG. 4, the bending blade 21 has guide grooves 22 at predetermined intervals into which driver cams 40 are fitted. The driver cam 40 has a sliding member 45 on an inclined surface of a driver portion 41 thereof. As described later, the driver portion 41 of the driver cam 40 is fitted into the guide groove 22 to make the slide cam 20 smoothly slide in a direction perpendicular to the press-forming direction. The driver cam 40 further has a sliding member 46 at the rear thereof, which allows the driver cam 40 to smoothly slide on the upper die holder 11. In addition, the bending blade 21 has a roll-off 21*c* to avoid interference or the like with the panel 80.

The slide cam 20 is connected to stoppers 23 connected to the upper die holder 11 at predetermined intervals via a resilient body 24, and as described later, the resilient bodies 24 urge the slide cam 20 into a rest position. As a result, play of the slide cam 20 is removed, and the quality of the press forming is improved. The resilient body 24 can be a resilient material, such as a spring and urethane rubber.

Figure 5:
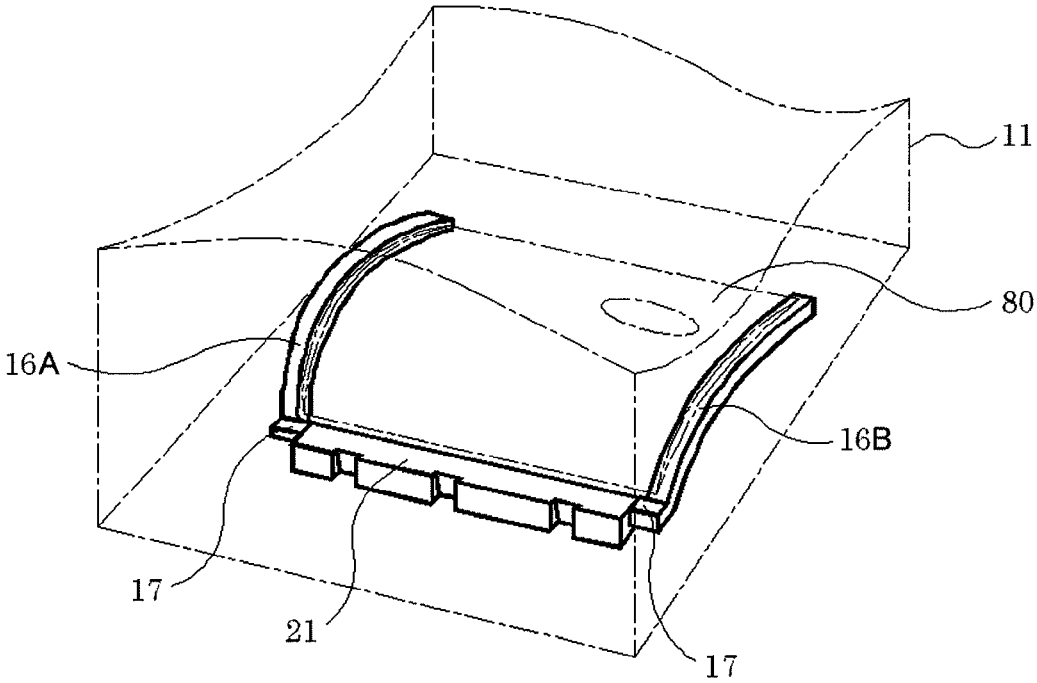
FIG. 5 is a diagram for illustrating attachment of bending blades of a fixed die and a bending blade of the slide cam to an upper die holder.

FIG. 5 shows a layout of the bending blade 16 of the fixed die 15 and the bending blade 21 of the slide cam 20. As shown in FIG. 5, in this embodiment, three edges of the panel 80 adjacent to each other are surrounded by the bending blades 16 and the bending blade 21. More specifically, bending blades 16A and 16B are disposed on the left and right of the panel 80 to be worked, and the bending blade 21 is disposed below the panel 80. The bending blade 16A, 16B has a protrusion 17 at an end thereof. The protrusions 17 slightly intrude into the bending blade 21 and are in contact with the bending blade 21 in such a manner that the protrusions 17 do not interfere with the bending blade 21 during operation. Thus, the peripheral edges of the panel 80 can be simultaneously worked to form a flange. As described above, the associated fixed punches 33 and 35 are provided for the bending blades 16 and 21.

Figure 6:
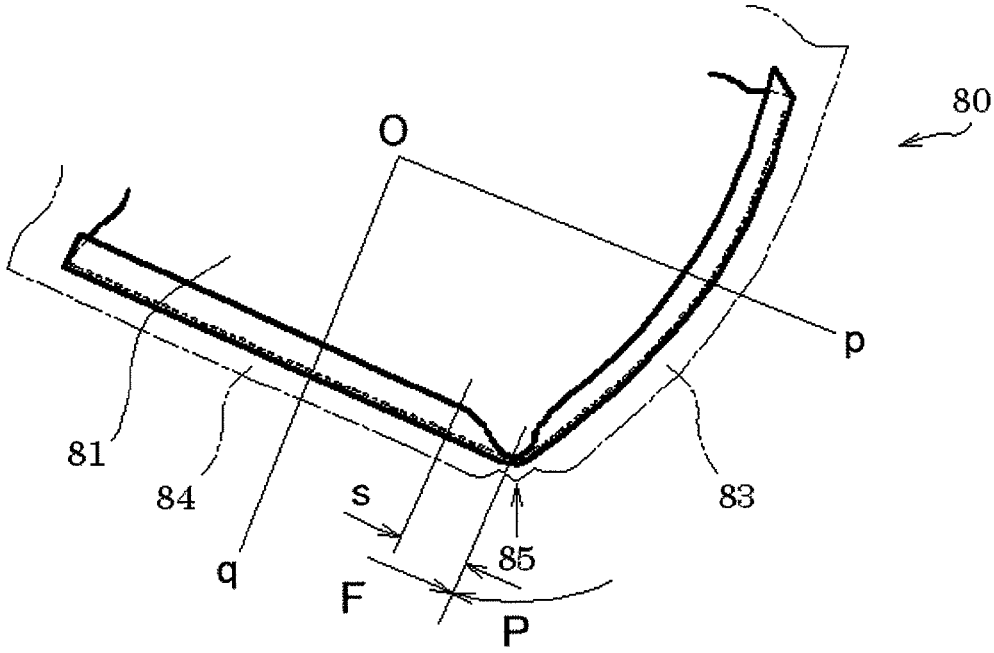
Figure 6:
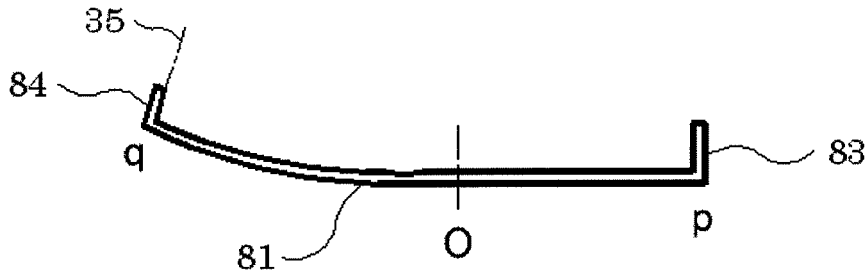

Using such a press die set for forming a flange, the panel 80 can be bent at a right angle and at a negative angle to form a flange as described later. FIG. 6 includes diagrams for illustrating a panel worked using the press die set for forming a flange according to an embodiment of the present invention. In FIG. 6, the alternate long and short dash line indicates the shape of the panel 80 yet to be worked, and the solid line indicates the shape of the panel 80 worked. Left and right edges (right-angle flanges 83) and a corner (a corner 85) of a panel-main body 81 of the panel 80 are portions to be bent at a right angle (P regions), and a lower edge (a negative-angle flange 84) of the panel-main body 81 is a portion to be bent at a negative angle (an F region). The boundary between the P region and the F region is the boundary between the bending blade 21 and the bending blade 16, which is generally referred to as parting line. As shown in FIG. 6(B), the portion to be bent at a negative angle is shaped to cover the expanded portion of the fixed punch 35.

In working the panel 80, first, as shown in FIGS. 1 and 2, the panel 80 is placed on the upper surface of the fixed punches 33 and 35, and then the pad 13 is lowered and pressed against the panel 80 to secure the panel 80 between the pad 13 and the fixed punches 33 and 35. Then, the upper die holder 11 is lowered to bend the left, right and lower edges of the panel 80 at a right angle between the bending blades 16 of the fixed die 15 and the fixed punch 33 and between the bending blade 21 of the slide cam 20 and the fixed punch 35 as described above. In this step, the bending blade 21 of the slide cam 20 first comes into contact with the panel 80 at the right-angle bending forming portion 21*a* at the top thereof, so that the panel 80 is bent at a right angle between the right-angle bending forming portion 21*a* and the fixed punch 35. FIG. 7(A) illustrates this step. The down arrow in FIG. 7(A) indicates the direction of lowering of the upper die holder 11 (the press-forming direction).

Figure 7:
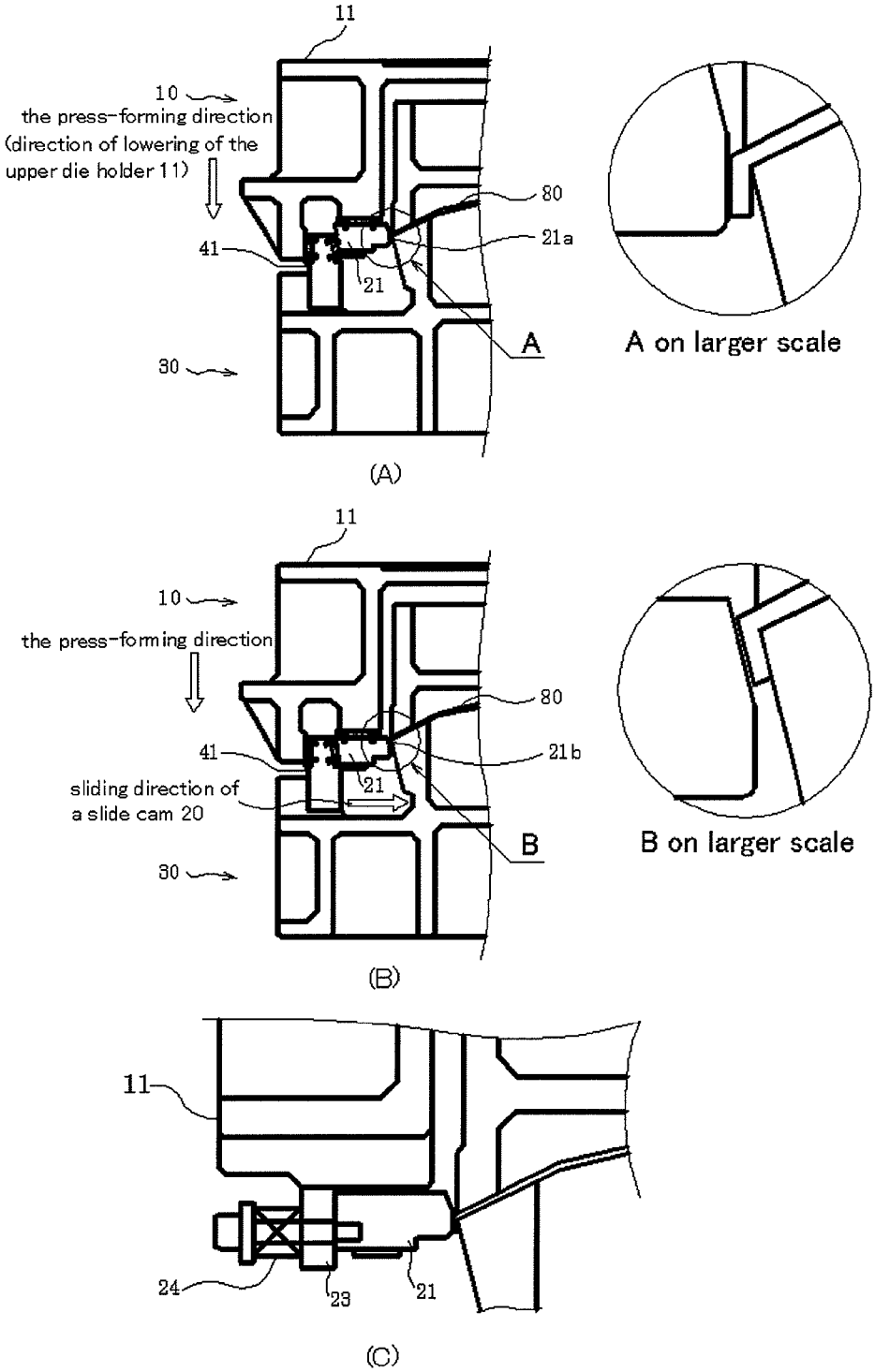
FIG. 7 includes diagrams for illustrating different steps in a process of bending the panel.

As the upper die holder 11 is lowered, when right-angle bending of the left, right and lower edges of the panel 80 is completed, negative-angle bending of the panel 80 is then carried out. As shown in FIG. 7(B), at the lower edge of the panel 80 to be bent at a negative angle, the surface of the sliding member 45 of the driver portion 41 of the driver cam 40 comes into contact with the guide groove 22 in the bending blade 21 of the slide cam 20 (FIG. 4). As the upper die holder 11 is further lowered, the slide cam 20 slides in the direction of the right arrow in FIG. 7(B) by being guided by the driver portion 41 of the driver cam 40. As a result, the lower edge of the panel 80 bent at a right angle as described above is further bent at a negative angle by the negative-angle bending forming portion 21*b* of the bending blade 21. Although the driver portion 41 is fitted between the upper die holder 11 and the guide groove 22 as shown in FIG. 7, the driver portion 41 has the sliding members 45 and 46 on the surfaces to come into contact therewith, so that the driver portion 41 smoothly slides between the upper die holder 11 and the guide groove 22.

In such right-angle bending and negative-angle bending of the panel 80, the slide cam 20 (the bending blade 21) is pulled toward the stopper 23 fixed to the upper die holder 11 by the action of the resilient body 24 as shown in FIG. 7(C). In other words, the slide cam 20 is urged by the resilient body 24 to come into contact with a surface of the stopper 23, and the position is the rest position of the slide cam 20. Thus, play of the slide cam 20 in the right-angle bending and the negative-angle bending is removed, and highly precise working is achieved.

Figure 8:
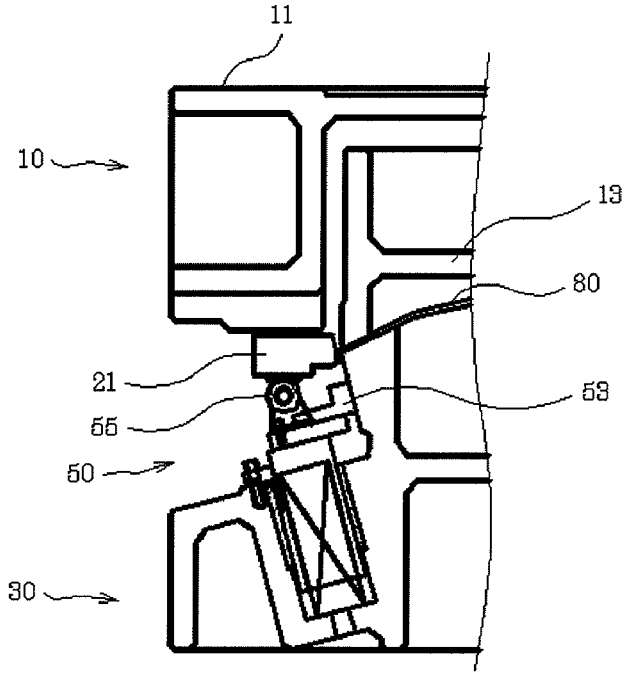
FIG. 8 includes diagrams for illustrating different steps in a process of releasing the panel from a lower die.
Figure 8:
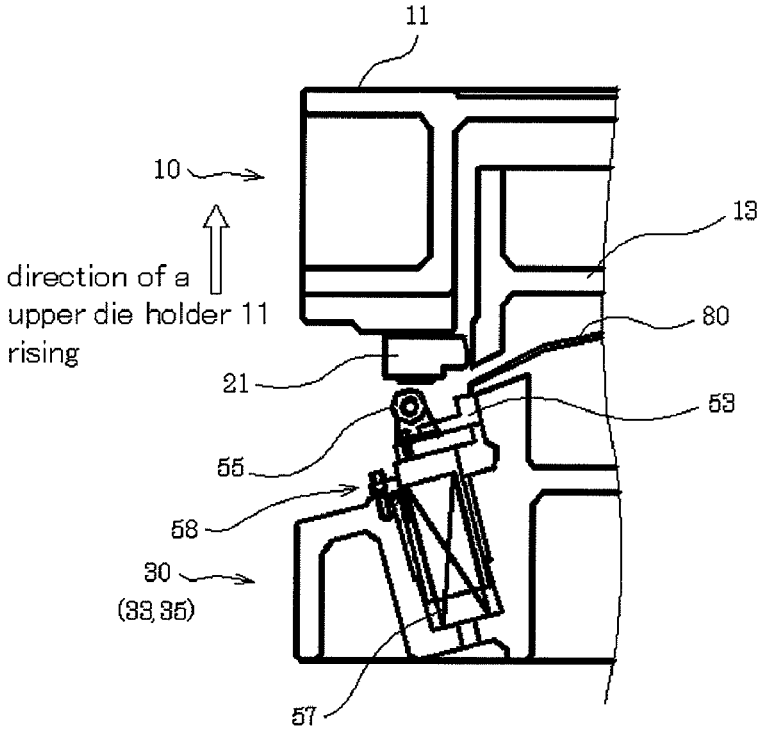

When the right-angle bending and the negative-angle bending are completed, then, the bent panel 80 is released from the fixed punches 33 and 35 (the lower die 30). The panel 80 is preferably released using a panel lifter 50 as shown in FIG. 8. FIG. 8(A) shows the panel 80 at the time when the bending is completed. FIG. 8(B) shows the bent panel 80 released from the lower die 30 using the panel lifter 50.

As shown in FIG. 8(A), when the bending is completed, a cam follower 55 of the panel lifter 50 abuts against the bending blade 21, and an ejector 53 is positioned below the panel 80. Then, the upper die holder 11 and the pad 13 are first raised. As the upper die holder 11 is raised, the slide cam 20 slides in the left direction in FIG. 8(A) by the action of the driver cam 40 and the resilient body 24 while moving upward. Thus, as shown in FIG. 8(B), the cam follower 55 is released from the bending blade 21, and by the action of pressing means 57, the ejector 53 abuts against an end face of a negative-angle flange 84 to press the panel 80, thereby releasing the panel 80 from the lower die 30 (the fixed punches 33 and 35).

To release the panel 80 from the lower die 30, the ejector 53 preferably exerts a uniform pressing force to the end face of the negative-angle flange 84. Therefore, for example, as shown in FIG. 4, the panel lifter 50 preferably has a plurality of pressing means 57 and a plurality of ejectors 53 with a coupling board 51 interposed therebetween as required. For the panel lifter 50, in order that the pressing means 57 is effective only within a predetermined distance, a stopper 58 or the like is used to limit the movement of the pressing means 57 after the panel 80 is released from the lower die 30. In addition, in order to effectively exert the pressing force to the end face of the negative-angle flange 84, the panel lifter 50 is disposed at the same angle as the bending angle of the negative-angle bending. For the panel lifter 50, as shown in FIG. 4, the pressing means 57 is housed in a case 56, and the cam follower 55 is rotatably coupled to the coupling board 51 via a bracket 54. The pressing means 57 can be a coil spring.

Right-angle bending and negative-angle bending of the panel 80 using the press die set for forming a flange according to an embodiment of the present invention have been described above. As described above, the bending blade 21 and the protrusions 17 of the bending blades 16 are in contact with each other at the respective parting lines. That is, a flange forming method according to an embodiment of the present invention differs from conventional flange forming methods in that the bending blade used for right-angle bending and the bending blade used for negative-angle bending do not overlap. In addition, as shown in FIG. 6, the parting line between the bending blades intrudes into the edge bent at a negative angle from the edge to be bent at a right angle. Thus, a strain or damage that is likely to occur in the transitional part between the right-angle part and the negative-angle part (the area indicated by a character s in FIG. 6) in conventional flange forming methods can be prevented. Furthermore, in the case where the parting line is positioned at the transition point from the corner 85 to the negative-angle flange 84 as shown in FIG. 6, the range of the transition part can be advantageously reduced.

The corner 85 is subject to drawing, and this makes it difficult to release the panel 80 from the lower die 30. Therefore, at the corner 85, the flange preferably has a height that prevents drawing of the flange and occurrence of overlapping wrinkles, for example, a height of 5 mm or less.

Description of Symbols

10 upper die
11 upper die holder
13 pad
15 fixed die
16 bending blade
17 protrusion
20 slide cam
21 bending blade
22 guide groove
23 stopper
24 resilient body
25 attachment bolt
26 hole
28, 29 sliding member

30 lower die
21 lower die holder
33, 35 fixed punch
40 driver cam
41 driver portion
45, 46 sliding member
50 panel lifter
51 coupling board
53 ejector
54 bracket
55 cam follower
56 case
57 pressing means
80 panel
81 panel-main body
83 right-angle flange
84 negative-angle flange
85 corner

What is claimed is:

1. A press die set for forming a flange that bends an edge of a panel at a right angle in a press-forming direction and an edge adjacent to the right angle edge at a negative angle, comprising:

an upper die having a fixed die used for right-angle bending and a slide cam used for negative-angle bending; and a lower die having a fixed punch associated with said fixed die, a fixed punch associated with said slide cam and a driver cam for guiding the slide cam, wherein a bending blade of said slide cam has a right-angle bending forming portion provided at the bottom of the bending blade, and a negative-angle bending forming portion immediately following the right-angle bending forming portion and including a slanted surface positioned at the top of the bending blade; and a panel lifter that abuts against an end face of a negative-angle flange to release the panel from the lower die;

wherein the panel lifter has a plurality of ejectors that abut against the end face of the negative-angle flange of the panel, a coupling board to which the ejectors are integrally attached, a plurality of pressing means that operate within a predetermined range in a releasing direction in which said negative-angle flange is released from the lower die and urge the coupling board in the releasing direction, and a cam follower that abuts against the slide cam to maintain said coupling board in a predetermined position when said negative-angle flange is being worked.

2. A flange forming method comprising bending an edge of a panel at a right angle in a press-forming direction and an edge adjacent to the right angle edge at a negative angle, wherein a part bent at a right angle and a part bent at a negative angle are adjacent to each other at a parting line, and the panel has a transitional part between the right angle edge and the negative angle edge, and a bending blade for a part bent at a right angle has a protrusion for bending said transitional part, and the bending blade for a part bent at a negative angle bends the negative angle edge and does not interfere with said protrusion.

3. The flange forming method according to claim 2, wherein the parting line intrudes into the edge to be bent at a negative angle from the edge to be bent at a right angle.

4. A press die set for forming a flange that bends an edge of a panel at a right angle in a press-forming direction and an edge adjacent to the right angle edge at a negative angle, comprising:

an upper die having a fixed die used for right-angle bending and a slide cam used for negative-angle bending;

a lower die having a fixed punch associated with said fixed die, a fixed punch associated with said slide cam and a driver cam for guiding the slide cam, wherein a bending blade of said slide cam has a right-angle bending forming portion provided at the top thereof and a negative-angle bending forming portion immediately following the right-angle bending forming portion; and a panel lifter that abuts against an end face of a negative-angle flange to release the panel from the lower die, wherein the panel lifter has a plurality of ejectors that abut against the end face of the negative-angle flange of the panel, a coupling board to which the ejectors are integrally attached, a plurality of pressing means that operate within a predetermined range in a releasing direction in which said negative-angle flange is released from the lower die and urge the coupling board in the releasing direction, and a cam follower that abuts against the slide cam to maintain said coupling board in a predetermined position when said negative-angle flange is being worked.

* * * * *